US005267008A

United States Patent [19]

Rebres et al.

[11] Patent Number: 5,267,008

[45] Date of Patent: Nov. 30, 1993

[54] FRICTION RETARD FEEDER WITH A COMPOSITE FEED ELEMENT

[75] Inventors: Robert P. Rebres, Webster; Janice F. Szocki Brooks, Fairport; Gerald M. Garavuso, Rochester; Youti Kuo, Penfield; David J. Lemmon, Hilton, all of N.Y.

[73] Assignee: Xerox Corporation, Stamford, Conn.

[21] Appl. No.: 812,592

[22] Filed: Dec. 23, 1991

[51] Int. Cl.[5] ..... G03G 21/00

[52] U.S. Cl. ..... 355/308; 271/119; 355/309; 355/321; 492/28; 492/30; 492/40

[58] Field of Search ..... 355/308, 309, 311, 319, 355/321, 23; 29/121.1, 121.6, 132, 124–125, 121.5; 271/109, 119, 120, 122; 492/16, 18, 25, 28, 29, 30, 40, 49, 52, 53

[56] References Cited

U.S. PATENT DOCUMENTS

| | | | |
|---|---|---|---|
| 2,085,575 | 6/1937 | Desbordes et al. | 29/125 |
| 3,235,940 | 2/1966 | Taylor et al. | 29/125 |
| 3,707,749 | 1/1973 | Henley | 29/1 |
| 3,883,293 | 5/1975 | McCarroll | 432/60 |
| 3,966,190 | 6/1976 | Grant | 271/119 X |
| 4,239,203 | 12/1980 | Uchida | 271/122 |
| 4,397,673 | 8/1983 | Stevens | 65/374.11 |
| 4,530,140 | 7/1985 | Okamura et al. | 29/110 |
| 4,770,550 | 9/1988 | Takahashi | 384/495 |
| 4,982,942 | 1/1991 | Konishi et al. | 271/119 |
| 5,149,077 | 9/1992 | Martin et al. | 271/119 X |

FOREIGN PATENT DOCUMENTS

| | | | |
|---|---|---|---|
| 0102344 | 6/1985 | Japan | 271/109 |

OTHER PUBLICATIONS

Xerox Disclosure Journal, vol. 8, No. 1, Jan./Feb., pp. 13–14, (1983).

*Primary Examiner*—A. T. Grimley
*Assistant Examiner*—Matthew S. Smith

[57] ABSTRACT

A composite friction feed roll includes one material which feeds fresh paper well and another material which reliably feeds paper which has passed through fusing and has oil on its imaged surface. Such a roll will feed deplex and fresh paper or inserts equally reliably. Suitable material combinations would be silicone rubber which handles fused copies with ease, but has limited life feeding fresh or virgin paper because it collects fibers from fresh paper, and isoprene which is long lived handling fresh paper, but is rapidly contaminated by fuser oil. In the steady state condition, silicone regions will be primarily active in feeding duplexed paper while the isoprene oil contaminated, while in the plain paper feeding case, isoprene regions will be primarily responsible for feeding while the silicone becomes paper debris contaminated.

18 Claims, 5 Drawing Sheets

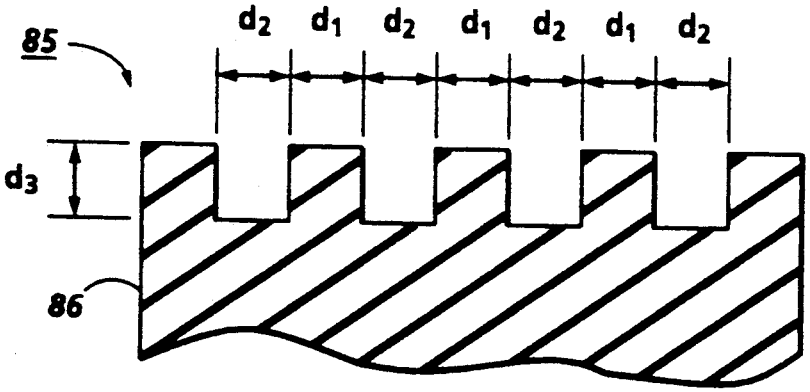
FIG. 3B
FIG. 4
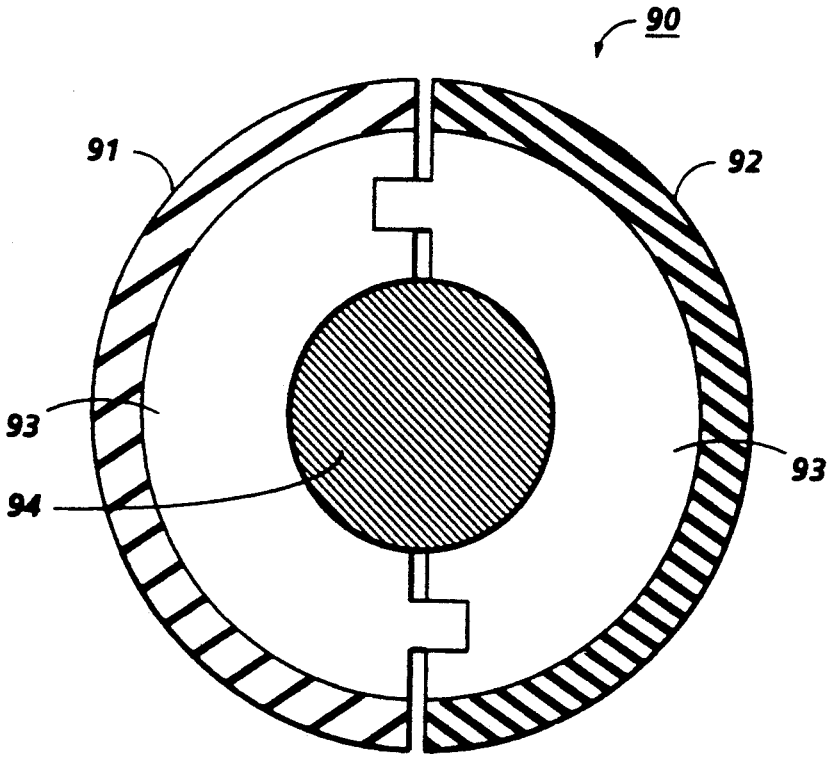

FRICTION RETARD FEEDER WITH A COMPOSITE FEED ELEMENT

This invention relates generally to a printer or copying machine, and more particularly, concerns a friction retard substrate feeding system for feeding substrates, which term is used herein to include sheets of any type, from a stack along a predetermined path.

The stacking and feeding of sheets (both copy sheets and original documents) is an important operation in reprographic machines and in document handling generally. In a reprographic machine, for example, original documents are re-stacked in the tray of a recirculating document handler after they have been copied and completed copies are stacked in an output tray of the machine. Within the machine itself, duplex copies may be stacked in an intermediate storage (or duplex buffer) tray between the two printing operations that are required to place images on both sides of the copy sheets. Friction retard feeders are sometimes used in these environments.

Friction retard feeders which utilize a retard member that requires a specified minimum and maximum value of coefficient of friction for adequate performance encounter early system life failure due to contamination from paper dust and fuser oil. For example, when using these friction retard feeders to function in duplex and virgin sheet or multi-sheet inserter modes on demand, i.e., one piece of hardware is used alternatively as a duplex, then as a plain sheet feeder, a problem arises. The problem in this type of application is that the fuser release agent (silicone oil) on copies classically contaminates the feed element, reducing its friction and thereby impacting decisions on stack normal force, i.e., an increase in stack normal force is designed into the feeder to offset a reduced friction coefficient. This increased stack normal force increases other failure modes including multi-feeding and sheet damage. Other feeder design trade offs may also be necessitated, such as, special retard entrance geometry, entrance gates, complex normal force control devices, etc.

Accordingly, in an aspect of the present invention, a friction retard feeder system that is efficient in feeding both virgin and simplexed sheets (sheets with an image on one side) and that minimizes coefficient of friction sensitivity requirements for retarding or multi-feeding, comprises a composite friction feed roll that includes one material which feeds virgin sheets well and another material which reliably feeds sheets that have passed through fusing and have oil on their surface. Suitable material combinations include silicone and isoprene rubber. These material composites offer increased feeder latitude due to stabilization of a major design parameter, i.e., the feed element coefficient.

The foregoing and other features of the present invention will be more apparent from the accompanying description taken in conjunction with the drawings wherein:

FIG. 3B is an enlarged partial end view of the composite feed roll of FIG. 3 showing dimensional relationship of the lands and grooves.

FIG. 4 is an enlarged side view of a composite feed roll incorporating elastomers in half-moon configuration.

While the present invention will be described hereinafter in connection with a preferred embodiment thereof, it will be understood that it is not intended to limit the invention to that embodiment. On the contrary, it is intended to cover all alternatives, modifications and equivalents as may be included within the scope of the invention as defined by the appended claims.

Figure 1:
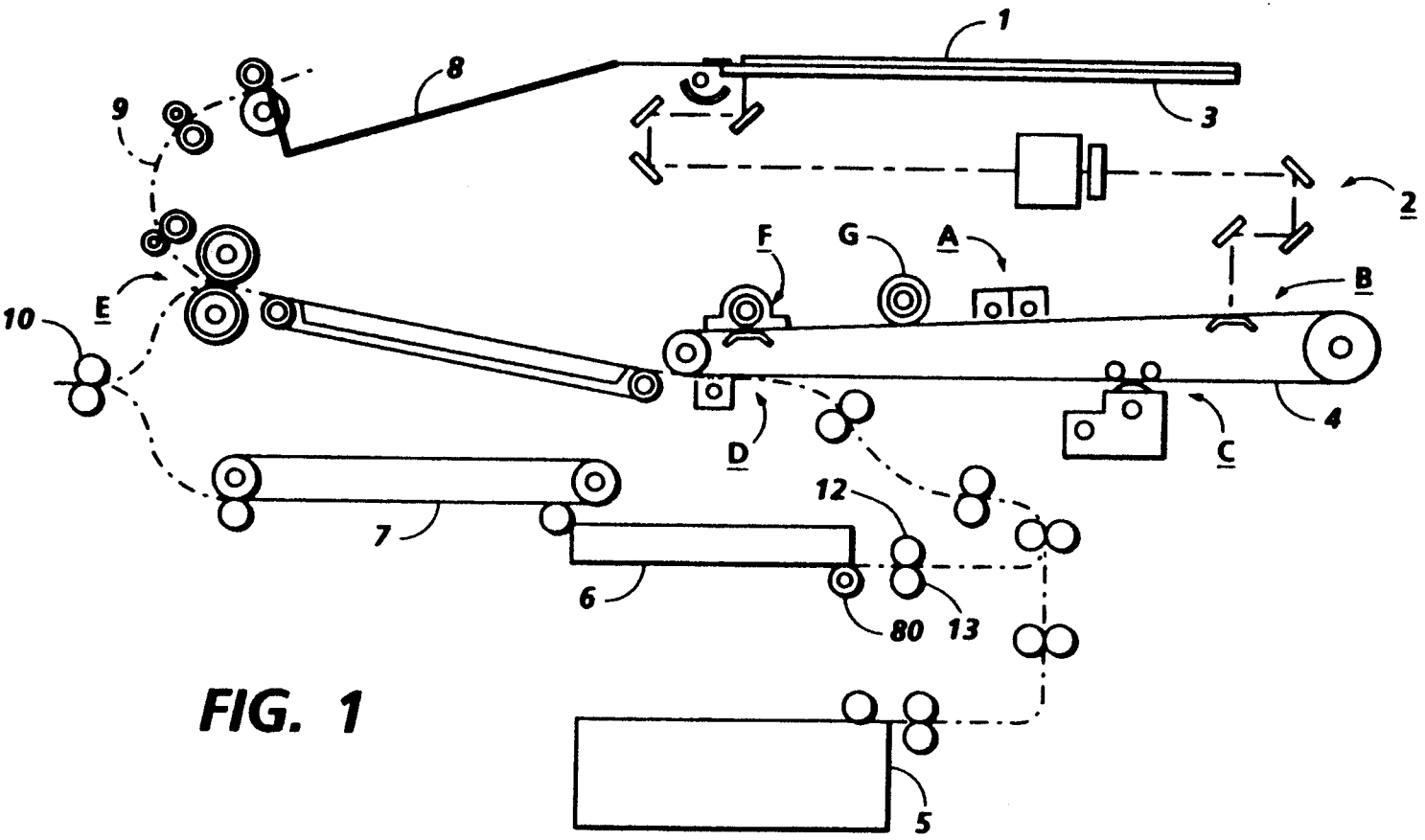
FIG. 1 is a schematic elevational view of an electrophotographic printing machine incorporating the features of the present invention.

For a general understanding of an electrophotographic printing machine in which the features of the present invention may be incorporated, reference is made to FIG. 1 which depicts schematically the various components thereof. Although the apparatus for forwarding sheets along a predetermined path is particularly well adapted for use in the electrophotographic printing machine in FIG. 1, it should become evident from the following discussion that it is equally well suited for use in a wide variety of devices and is not necessarily limited in its application to the particular embodiment shown herein. For example, the apparatus of the present invention will be described hereinafter with reference to feeding successive copy sheets, however, one skilled in the art will appreciate that it may also be employed for feeding successive original documents.

The sheet feeding apparatus described below is associated with the duplex buffer tray of a copier although it could be used in other situations when sheets are to be stacked in a location to which they are fed one after another. A duplex buffer tray is provided in a copier when duplex copies are to be produced and its function will be described briefly with reference to FIG. 1.

In the copier shown in FIG. 1, original documents are fed, one after another (for example by a recirculating document handler, not shown) to the platen 3 of the copier. When a document 1 is on the platen 3, an electrostatic latent image of the document is formed at an exposure station B on the photoreceptor belt 4 of the copier. The image is formed by an imaging system indicated generally at 2 and, thereafter, the document is returned to a storage tray (not shown).

Also associated with the photoreceptor belt 4 are a charging station A at which the belt is charged to a relatively high uniform potential upstream of exposure station B; a development station C at which the latent image is developed with toner particles; a transfer station D at which the toner image is transferred to a copy sheet; and a cleaning station F at which residual toner particles are removed from the belt 4 which is then illuminated by a lamp G to remove any residual charge before the start of the next cycle. These operations are all well known and need not be described in detail.

A tray 5 is provided to hold a supply of clean or virgin sheets onto which images of the documents fed to platen 3 are to be printed. Sheets are fed from the tray 5 to the transfer station D at the photoreceptor belt 4 and, following the transfer of a toner powder image from the photoreceptor, each sheet is then fed to a fusing station E where the transferred image is fused to the sheet. From the fusing station E, copy sheets will be deflected either to a duplex buffer tray 6 via a belt feeder 7 or to the copier output tray 8 via an output path 9.

Sheets deflected to the duplex tray 6 travel via an inverter (of which only the inverter nip 10 is shown) so that they are stacked image face up in the tray, in the order in which they were printed. They are then fed from the bottom of the stack back to the transfer station D at the photoreceptor belt 4, for the transfer of an image to the second side. The now-duplexed copy sheets are then fed into the output path 9 of the copier and finally to the output tray 8. From tray 6, one sheet at a time is advanced from the bottom of the supply of sheets by an intermittently operated paper feed roll 80 into the nip of retard roll pair 12, 13. The lower roll 13 is driven in a sheet feed direction while the upper roll 12 is driven in the reverse or sheet reject direction through suitable slip coupling which normally enables the lower roll 13 to override the reverse drive input to roll 12 and thereby turn roll 12 in the sheet feeding direction. However, if two or more sheets enter the nip of roll pair 12, 13, the reduced friction between the overlapping sheets reduces the frictional drive force between the roll pair 12, 13, permitting the slip clutch to engage and drive roll 12 in the reverse, sheet rejection direction.

Further description of the copier is not required for an understanding of the sheet feeding apparatus 80 of the present invention which will now be described in greater detail with reference to FIG. 2.

Classically, there is one feed element material, such as, GE RTV-112 silicone rubber that is found to be most optimal for feeding fresh copies, i.e., it functions best in the duplex feeder mode and a different feed element material, such as isoprene (Xerox material specification No. 34-0001) that functions best as a plain paper feed element material. These elements function best in their respective modes because their friction coefficients, against the respective sheets are relatively large and relatively stable in their respective environments. This promotes and allows a suitable feeder latitude in that mode, i.e., the critical feeder parameters can be varied within a range which is greater than or equal to expected manufacturing tolerances without adversely impacting feeder failure modes and rates.

The composite feed roll 80 of the present invention combines an optimum preferred duplex mode material, such as, GE RTV-112 silicone rubber 81 made by General Electric Corporation with an isoprene material 82, a optimum preferred plain paper feeder mode material mounted on hub 83 so that each material is always present and can effect a stable composite element friction level with all sheets to be fed, including duplex copies, transparencies, virgin sheets, etc. It should be understood that other configurations of composite roll 80 are envisioned, such as a bar bell roll, a feed belt or a combination of the two.

Figure 3A:
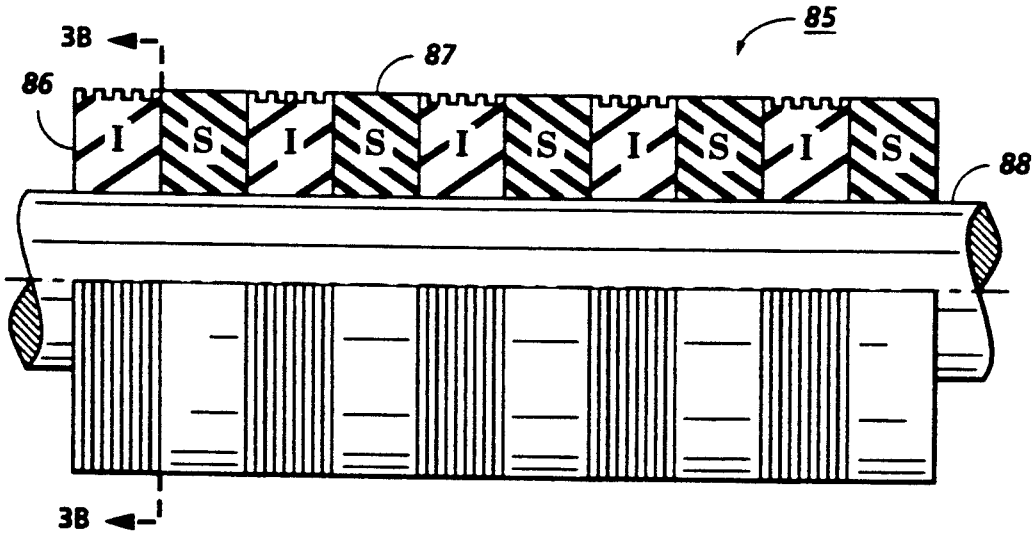
FIG. 3A is an enlarged partial end view of an alternative composite feed roll structure incorporating grooves in a portion of its surface.

Alternatively, as shown in FIG. 3A, the wear rate of the silicone elements of feed element 85 can be adjusted by changing the effective pressure between the feed element 85 and the sheet being fed so as to accommodate differences in wear rates of the composite roll segments. Composite feed roll 85 has grooved isoprene segments 86 separated by non-grooved silicone segments 87 mounted on hub 88. With this roll, approximately uniform wear is achieve by adjusting effective pressures applied to both material segments so as to offset inherently different wear rates of the isoprene material and the silicone material. The addition of grooves to the lower wear rate material (isoprene) can adjust its wear rate upward to equal that of the silicone rubber roll segments. The enabler for this roll is that the $d_1$ distance of FIG. 3B must be constant over $d_3$ so that the pressure area will be constant as wear occurs. Obviously, this could also be applied in a different feed element configuration. However, in this roll configuration, it is especially advantageous since roll segments can be individually molded, pressed onto a hub and ground cylindrically at their outside diameter. The $d_2$ dimension can be the same as $d_1$ and $d_3$. It should be understood that while dimensions $d_1$, $d_2$ and $d_3$ are shown as equals in FIG. 3B, different ratios can also be used.

Figure 5:
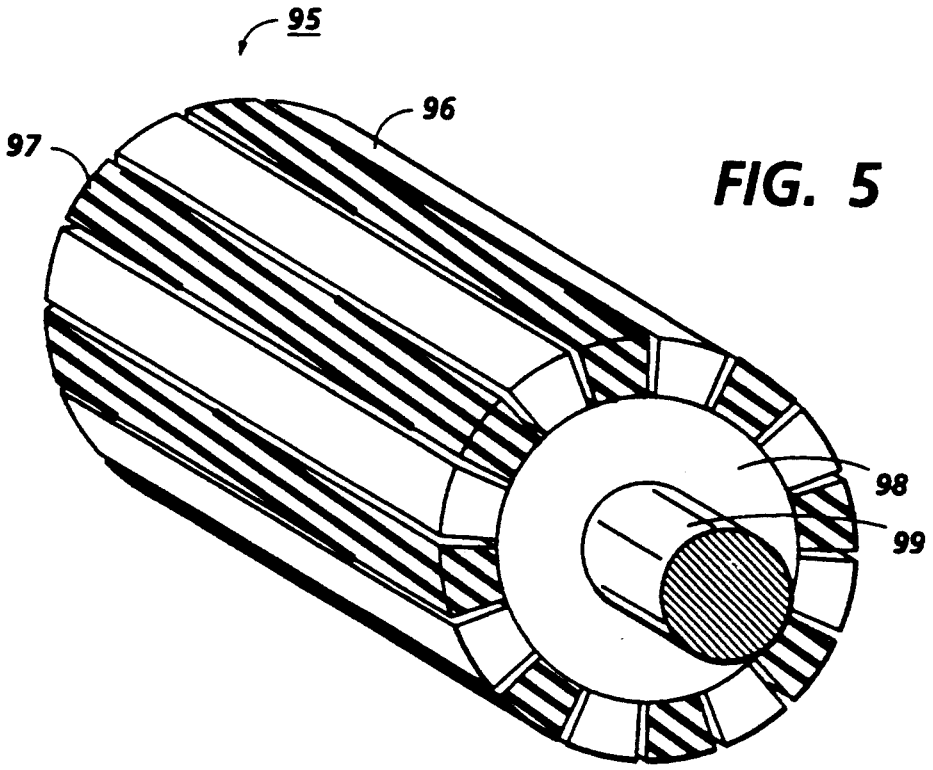
FIG. 5 is an enlarged isometric view of a composite feed roll incorporating elastomers extending axially of the roll.

Alternative composite roll configurations are shown in FIGS. 4 and 5 that include two different elastomer materials, whose functional properties compensate each other for feeding a wide variety of substrates reliably. Each roll functions are required because of the alternate contacts of two materials for driving and feeding substrates. As shown, alternate patterns of two materials are placed in series in the direction of the paper path. With this pattern only one material contacts a substrate at anytime, but the substrate will be driven through alternate contacts of the two materials. By this means, the substrate is driven by the full friction force of each material since each time in contact with the substrate, the material is under the total normal force of the loading system.

Figure 2:
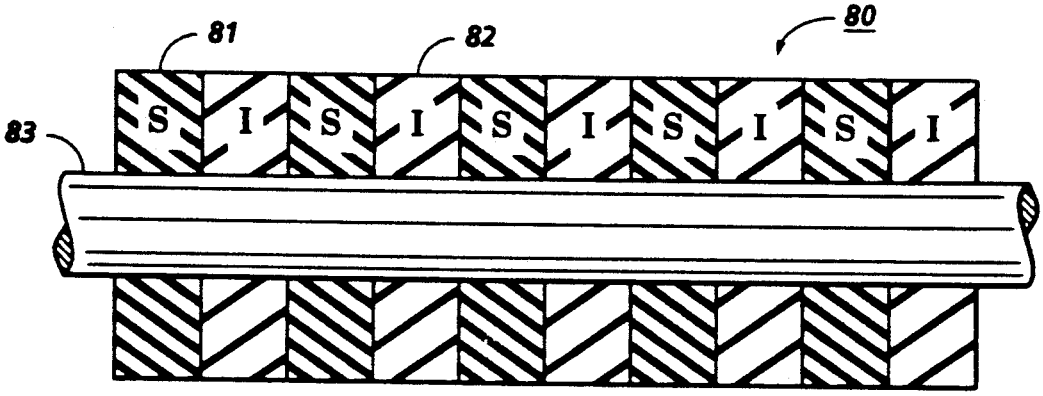
FIG. 2 is an enlarged partial end view of the substrate composite feed roll of the present invention used in the printing machine of FIG. 1.

In FIG. 4, composite roll 90 comprises two half-moon shaped halves 93 having different elastomers 91 and 92 coated thereon which could be isoprene and silicone materials as used in the roll configuration of FIG. 2. Material 91 has a higher coefficient of friction for plain paper than material 92, while material 92 has a higher coefficient of friction than material 91 for papers having a fused image thereon. To ensure proper feeding, this embodiment requires the use of an over-drive clutch (not shown) attached to shaft 94. Initially, if material 91 skids on a fused sheet, then further rotation of the composite roll will drive the fused sheet by material 92. Similarly, the material 92 may initially fail to move a sheet of plain paper, but continuous turning or rotation of the composite roll will cause material 91 to drive the plain paper. The drive system for the composite roll is designed such that once the lead edge of a substrate is captured by the nip of a take away roll running at a higher speed, the take away roll will take over active driving by disengaging the over-drive clutch (by the pulling force of the take away roll) on composite roll 90 so that the composite roll is free to rotate, i.e., driven by the paper. Feed rolls 80, 90 and 95 could be configured as belts, if desired.

To reduce large variations in the feed time of the two halves of composite roll 90 of FIG. 4, composite roll 95 can be made of narrow strips 96 and 97 of two elastomer materials bonded in an alternate pattern on a core 98 mounted on a shaft 99 as shown in FIG. 5. It is apparent that this feed roll has similar skid-feed behavior as composite feed roll 90, but it has shorter skid-feed intervals, which reduce variations in feed time. Feed roll 95 can be fabricated by providing slots in core member 98 and alternately filling the slots with the two elastomer materials.

Figure 6:
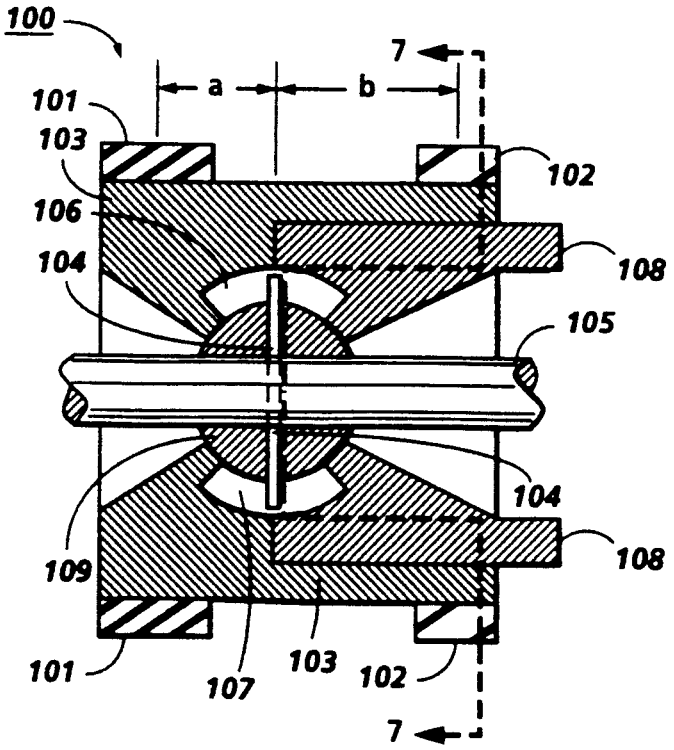
FIG. 6 is an enlarged partial side view of an alternative embodiment of a composite feed roll of the present invention that is self-adjusting with respect to a sheet to be fed.
Figure 7:
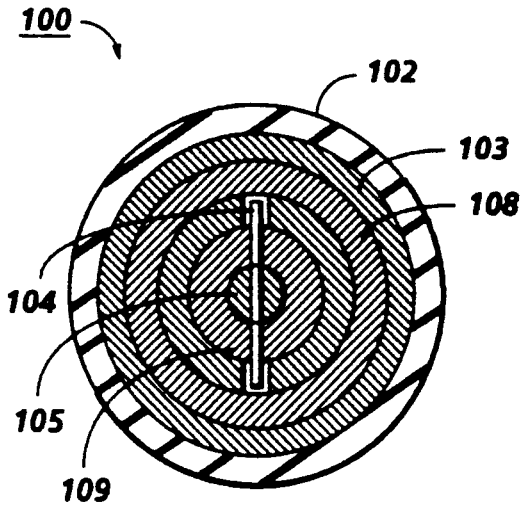
FIG. 7 is an enlarged end view of the composite feed roll of FIG. 6.

In a different embodiment of the present invention in FIGS. 6 and 7, a composite fed roll 100 is shown that accomplishes applying the correct fraction of a total normal force applied by the roll distributed reliably to each of two elastomer materials, such as, silicone 101 and isoprene 102 in a top sheet feeding environment. A floating roll 100 is employed which adjusts itself to sit flat on a sheet of paper. Variations in the distribution of normal force is enabled through altering the symmetry of the roll by placing the silicone 101 and isoprene 102 on support member 103 asymmetrically, i.e., the distance "a" from the center of pin 104 in ball 109 to the center of silicone 101 is less than distance "b" from the center of pin 104 to the center of isoprene 102. Pin 104 is mounted within shaft 105 and adapted to pivot or "float" within slots 106 and 107 formed by support members 103 and 108. This assembly will float on the surface of a stack of paper so as to maintain constant and predictable contact of both materials with the paper even when shaft 105 and the paper stack are not aligned. With respect to FIG. 7, the assembly will rotate from top to bottom by allowing pin 104 to slide within slots 106 and 107 created by support members 103 and 108. If desired, rather than joining across the middle, support member 103 could present one sliding surface for pin 104 while support member 108 could provide the opposite sliding surface. Also, the assembly can rotate from side to side about pin 104 as viewed in FIG. 7.

Figure 8:
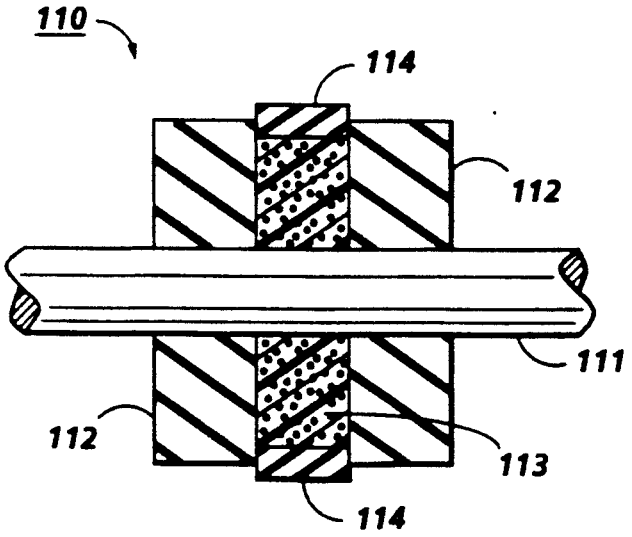
FIG. 8 is an elevation view of another composite feed roll of the present invention which incorporates foam-like material to support an elastomer.

Other approaches that achieve the desired pressure distribution include building compliance into the elastomer material (silicone or isoprene) either by mounting one or both materials on a compliant substrate such as foams; substituting a compliant silicone foam for the silicone rubber; or artificially increasing the compliance by grooving the surface of one or both materials or perforating the material below the active surface to make it softer. For example, in FIG. 8, feed roll 110 comprises a shaft 111 with spaced apart isoprene annular members 112 mounted thereon. An annular foam material 113 is positioned on the shaft between the isoprene members with a silicone annular member 114 mounted thereover. It should be understood that adding compliance creates a larger footprint of the roll on the paper resulting in lower pressure for the same normal force, and consequently higher friction.

In recapitulation, the machine in FIG. 1 has a duplex module that includes a friction retard feeder which acts as both a duplex feeder and as a virgin paper feeder while operating in different modes. A problem arises in selecting a single feed roll material for this application since the material of choice for virgin paper, namely isoprene, is not the material of choice for fused copies that are to be duplexed. Isoprene provides a very high friction when feeding virgin paper but the fuser oil found on fresh imaged or fused copies degrades that friction to an unacceptably low level. Silicone rubbers are typically used to drive fused copies since the friction of these materials do not degrade as badly as others. Unfortunately, silicone rubbers are easily contaminated by virgin paper debris making this an undesirable choice for a virgin paper feed roll material. In answer to this problem, a composite feed roll is provided that includes both isoprene and silicone material mounted on a shaft in alternating succession in order to obtain maximum feeding latitudes for fused and unfused sheet feeding and to improve the wear rate of the silicone material through time shared wear.

What is claimed is:

1. A friction feeder system that minimizes coefficient of friction sensitivity requirements for feeding imaged and unimaged sheets, comprising:

sheet support means for supporting a stack of sheets for feeding in a predetermined direction; and composite feed roll means positioned in contacting relation with an adjacent sheet of the stack for feeding the same in said predetermined direction, said composite feed roll means including portions of silicone and isoprene material.

2. The feeder system of claim 1, wherein said silicone and isoprene portions are mounted on a shaft, and wherein said silicone and isoprene portions comprise alternating axially extending strips which extend transverse to said predetermined direction.

3. The feeder system of claim 1, wherein said silicone and isoprene portions of said composite feed roll are half-moon shaped.

4. The feeder system of claim 1, wherein said isoprene portion has grooves in its sheet contacting surface.

5. The feeder system of claim 4, wherein said silicone portions have a flat sheet contacting surface.

6. In a copier/printer having a photoreceptor, an imaging system for forming images of documents on said photoreceptor, a predetermined paper path, and a feeder for advancing a sheet from a stack into said paper path to receive the images from said photoreceptor, the improvement comprising:

support means for supporting the stack of paper; and composite feed roll means positioned in contacting relationship with an adjacent sheet of the stack, said composite feed roll means including portions of silicone and isoprene materials.

7. In a method for improving the life and reliability of feeder systems that includes a feed member, the improved steps of:

providing a shaft;

mounting the feed member on said shaft;

applying alternating elastomeric materials to the surface of the feed member, and wherein said elastomeric materials are silicone and isoprene materials; and rotating the feed member.

8. The method of claim 7, including the step of providing said silicone and isoprene materials in half-moon configuration.

9. The method of claim 7, including the step of providing said silicone and isoprene materials on the surface of the feed roll in alternating axial strips.

10. The method of claim 9, including the step of providing grooves in said isoprene material.

11. The method of claim 7, including the step of providing said silicone and isoprene materials in annular bands.

12. The friction feeder system adapted to reliably feed both imaged and unimaged sheets, comprising:

sheet support means for supporting a stack of sheets to be fed;

retard means for ensuring that only one sheet is fed from said support means; and composite feed roll means that includes at least two elastomers for feeding both imaged and unimaged sheets and which self adjusts to ensure required partitioning of load to each elastomer.

13. The feeder system of claim 12, wherein said elastomers include silicone and isoprene materials.

14. The feeder system of claim 13, wherein said silicone and isoprene are in annular bands mounted on a core which is pivotally mounted on a shaft.

15. The feeder system of claim 14, wherein said annular bands of silicone and isoprene have different widths and are mounted asymmetrically with respect to said core.

16. The friction feeder system adapted to reliably feed both imaged and unimaged sheets, comprising:

sheet support means for supporting a stack of sheets to be fed;

retard means for ensuring that only one sheet is fed from said sheet support means;

composite feed roll means that includes at least two elastomers for feeding both imaged and unimaged sheets;

a shaft for supporting said composite feed roll for rotational movement, and wherein a compliant material is positioned between said shaft and one of said elastomers in order to create a large footprint of said composite feed roll on a sheet to be fed resulting in lower pressure and to compensate for wear of said one of said elastomers which is mounted over compliant material.

17. The feeder system of claim 16, wherein said compliant material is made of foam.

18. The feeder system of claim 17, wherein said one elastomer is silicone rubber.

* * * * *